United States Patent [19]

Montagu

[11] Patent Number: 4,462,014

[45] Date of Patent: Jul. 24, 1984

[54] WIDE-ANGLE ACTUATOR

[75] Inventor: Jean I. Montagu, Brookline, Mass.

[73] Assignee: General Scanning Inc., Watertown, Mass.

[21] Appl. No.: 402,432

[22] Filed: Jul. 28, 1982

[51] Int. Cl.[3] ..... H01F 7/14

[52] U.S. Cl. ..... 335/230; 335/272

[58] Field of Search ..... 335/229, 230, 272, 279, 335/281; 310/49 R

[56] References Cited

U.S. PATENT DOCUMENTS

| | | | |
|---|---|---|---|
| Re. 26,749 | 1/1970 | Montagu | 335/229 |
| 2,289,227 | 7/1942 | Walker | 335/272 X |
| 2,364,656 | 12/1944 | Price | 335/272 |
| 2,987,657 | 6/1961 | Buchtenkirch et al. | 335/272 X |
| 3,434,082 | 3/1969 | Montagu | 335/229 |
| 3,624,574 | 11/1969 | Montagu | 335/230 |
| 3,753,180 | 8/1973 | Sommer | 335/272 |
| 3,970,979 | 7/1976 | Montagu | 335/229 |
| 4,103,191 | 7/1978 | Kawamura et al. | 310/49 R |

OTHER PUBLICATIONS

Mizoshita et al., "Mechanical and Servo Design of a 10 Inch Disk Drive", IEEE Transactions on Magnetics, vol. MAG-17, No. 4, Jul., 1981, pp. 1387-1391.

Winfrey et al., "Design of a High Performance Rotary Positioner for a Magnetic Disk Memory", IEEE Transactions on Magnetics, vol. MAG-17, No. 4, Jul., 1981, pp. 1392-1395.

*Primary Examiner*—George Harris

[57] ABSTRACT

A limited-rotation actuator in which the rotor pole faces and corresponding stator pole faces are spaced apart along the axis of rotation, the rotor pole faces are permeably connected by a flux path having an axial component through the rotor, and the rotor and stator pole faces each subtend an angle of between about 90° and about 180° around the axis. The invention enables wide angle excursions of the rotor and inexpensive fabrication.

13 Claims, 11 Drawing Figures

FIG 1
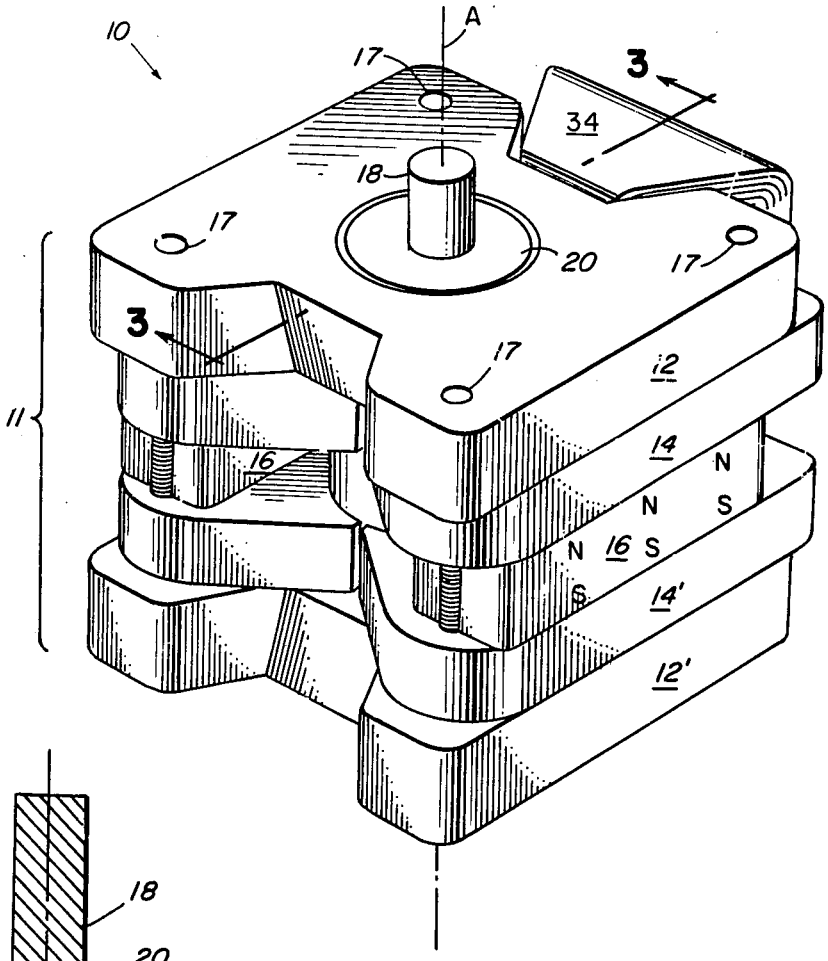
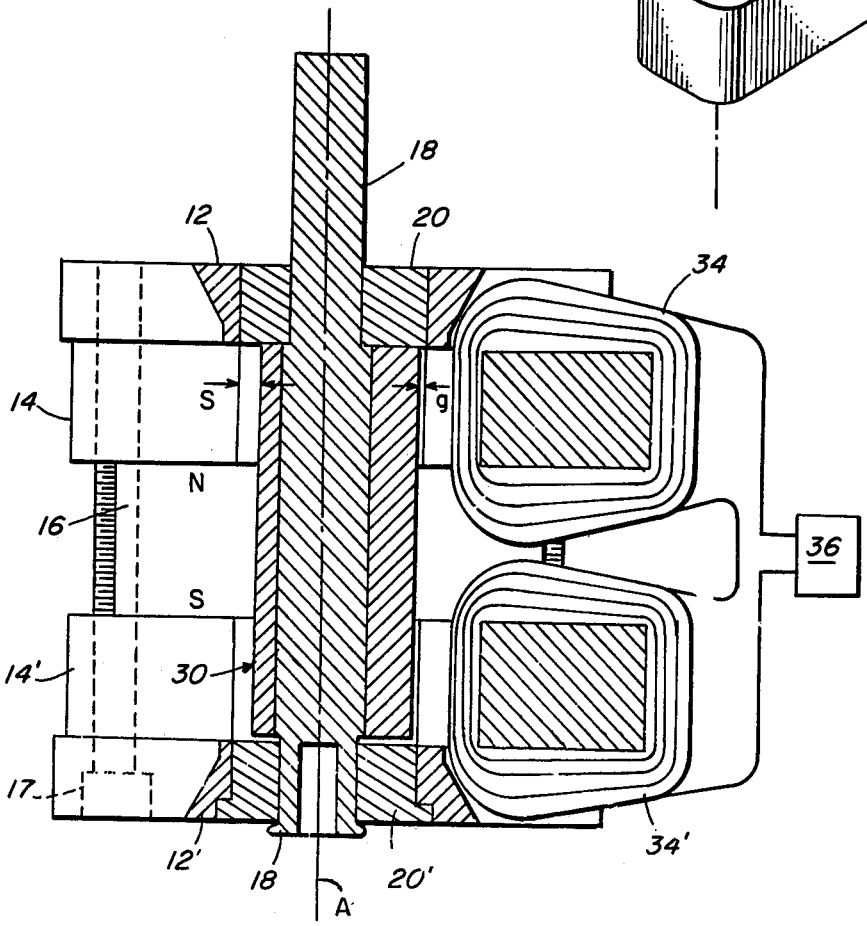
FIG 3

WIDE-ANGLE ACTUATOR

BACKGROUND OF THE INVENTION

This invention relates to limited rotation electromechanical actuators that have so-called moving iron rotors.

In actuators of this type, a permeable rotor assembly defines rotor pole faces and is mounted to rotate relative to a stator assembly. The stator assembly has a pair of pole pieces (each having a pair of stator pole faces arranged around the rotor axis) and a permanent magnet which imposes a biasing flux through the pole pieces and the rotor assembly via corresponding pairs of the rotor and stator pole faces. Typically the angular excursion is limited to a peak-to-peak excursion of about 60°.

SUMMARY OF THE INVENTION

The invention features an actuator in which the rotor pole faces are spaced apart along the axis of rotation and permeably connected by a flux path having an axial component through the rotor assembly and the rotor and stator pole faces each subtend an angle of between about 90° and about 180° around the axis. Such a construction enables low-cost fabrication and wide-angle excursions.

In preferred embodiments, each rotor pole face subtends an angle of approximately 180°; each stator pole face subtends an angle between about 120° and about 160°; the pole pieces are located in substantially parallel planes, the planes being perpendicular to and spaced apart along the axis, and each pair of stator pole faces is permeably connected by a connecting portion of its respective pole piece around which a flux-generating current-carrying coil is wrapped; the permanent magnet means is a permanent magnet positioned in the axial space between the pole pieces; the connecting portions of the pole pieces are respectively aligned or are oriented 180 degrees apart with respect to the axis; the rotor assembly comprises a pair of permeably connected segments at different positions along the axis, each segment comprising a pair of arcuate sections of different radii centered on the axis, the arcuate section which has the larger radius defining one rotor pole face, and the other arcuate section defining a relief surface, the space between the relief surface and the stator pole faces being sufficiently large to be substantially impermeable; the rotor pole faces are located respectively on the same side or on opposite sides of the axis; and there is also a cylindrical segment having a radius greater than the smaller said radius, the cylindrical segment being centered on the axis, positioned axially intermediate the segments, and permeably connected to the segment.

The improvement enables the biasing flux generated by the permanent magnet and the control flux generated by current flowing through the coils to be properly maintained over a wide angle of excursion, with rapid response time for the rotor to reach any desired angular position, all in a compact, easy to manufacture, economical, and sturdy unit.

Other features and advantages of the invention will be apparent from the following description of the preferred embodiment and from the claims.

DESCRIPTION OF PREFERRED EMBODIMENT

We first briefly describe the drawings.

Drawings

FIG. 1 is an isometric view of a preferred embodiment of the actuator.

FIG. 3 is a sectional side view (at section 3—3 of FIG. 1) of the actuator of FIG. 1.

STRUCTURE AND MANUFACTURE

Figure 2:
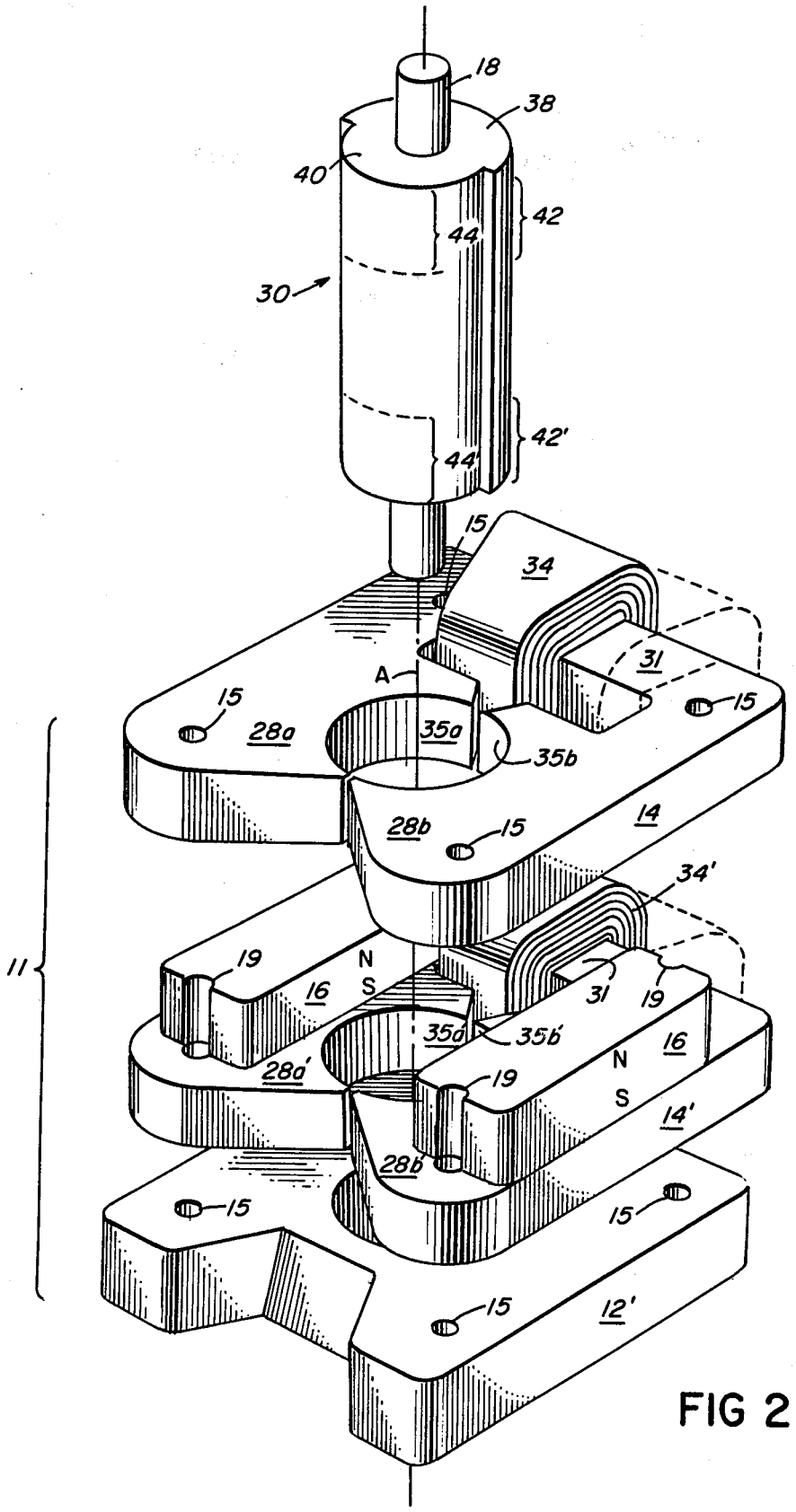
FIG. 2 is an exploded isometric view of the actuator of FIG. 1, with one end cap removed, the rotor assembly shown axially separated from the stator assembly, and the coils shown cut away.

Referring to FIGS. 1 and 2, the actuator has a stator assembly 11 including two end caps 12, 12', between which are stacked, along axis A, two pole pieces 14, 14' and (between the pole pieces) two permanent magnets 16. The stator assembly is held together by four assembly screws 17. Rotor shaft 18 (preferably ferromagnetic) is journaled in a pair of bearings 20, 20' (20' being hidden in FIG. 1) which are respectively held in end caps 12, 12'.

Referring to FIGS. 2, 3, ¾" long ferromagnetic rotor 30 (force fitted onto shaft 18) has two semi-cylindrical sections of different diameters 38, 40. The curved outer surface of the larger diameter (e.g., 0.605" diameter) semi-cylindrical section 38 defines two rotor pole faces 42, 42' (hidden in FIG. 2) and the curved outer surface of the smaller diameter (e.g., 0.500" diameter) semi-cylindrical section 40 similarly defines two relief areas 44, 44'.

Stator assembly 11 has two identically-shaped, flat ferromagnetic pole pieces 14, 14', spaced apart along axis A, positioned parallel to one another and perpendicular to axis A, and separated by two rectangular sintered alnico biasing magnets 16 which generate a bias field. Each magnet is approximately 1.4 inches long, 0.62 inches wide and 0.25 inches thick and has a north pole face in flux-conducting contact with a flat axially directed surface of one of the pole pieces and a corresponding south pole face in flux-conducting contact with a flat axially-directed surface of the other pole piece.

Each pole piece 14, 14' is approximately 2 inches square and 0.375 inches thick and has two legs 28*a*, 28*b*; 28*a'*, 28*b'*, respectively, joined at one end by a respective highly permeable connecting segment 31, 31'. The two legs of each pole piece are shaped to form two almost semi-circular (e.g., subtending 160° around axis A) stator pole faces 35*a*, 35*b*; 35*a'*, 35*b'* which are directed toward one another to define a 0.625" diameter round opening. The connecting segment of each pole piece is wrapped by a 600-turn insulated-wire control coil 34, 34' for carrying a current of 0.5 amps. The two control coils are connected in series and then to a controlled source of variable current 36.

The two pole pieces are positioned with their connecting segments on the same side of axis A, with the round openings in the two pole pieces in line to receive the rotor assembly. The rotor pole faces 42, 42' have a slightly smaller diameter than stator pole faces 35*a*, 35*b*, 35*a'*, 35*b'* for rotating clearance. When the actuator is assembled, the rotor is held in a fixed axial position by bearings 20, 20' and can rotate freely. Each rotor pole face (e.g., upper rotor pole face 42) bridges the corresponding two stator pole faces (e.g., upper stator pole faces 35*a*, 35*b*) in all positions within the wide angular excursion of the rotor. The radial gaps g between each rotor pole face and each of the corresponding two stator pole faces are small enough (e.g., about 0.008") to provide low reluctance magnetic flux paths across those gaps, while the radial spaces s between relief areas 44, 44' and the corresponding pole faces 35*a*, 35*b*; 35*a'*, 35*b'* are large enough to prevent the flow of magnetic flux across those spaces. The difference in radii between the two sections of the rotor is about eight times the gap g between the stator and rotor pole faces.

Each pole piece has four assembly holes 15 and the ends of the magnets have retaining slots 19, the holes and slots being arranged to receive bolts to hold the pole pieces and magnets rigidly in place. The magnets are sufficiently thick to separate the pole pieces by a space which prevents coils 34, 34' from touching each other.

End caps 12, 12' (cast or machined aluminum or sintered non-magnetic stainless steel) are 0.250 inches thick, 2 inches long and 1.8 inches wide. Both end caps have a 0.625" center hole for mounting a bearing 20, 20' and four holes 15 for screws 17. The four holes in end cap 12 are tapped to receive the threaded ends of the screws and the four holes in end cap 12' are countersunk to receive the screw heads.

The actuator is manufactured inexpensively by using sintered magnets (ground only on the two surfaces which contact the pole pieces), stamped metal pole pieces, die cast end caps, and extrusions for the rotor segments. The parts are easily assembled using a simple mandrel. Alignment is simplified (as compared with conventional actuator) because each pole piece is an integral part having an almost full circular hole the bounding surfaces of which can contact and be accurately aligned by the mandrel. The other dimensions of the magnets need not be precisely machined because small differences in their dimensions will not affect the size of the gaps g between the rotor pole faces and the stator pole faces.

OPERATION

The biasing magnets establish a continuous biasing flux flow through the stator and rotor assemblies whose path through the rotor is always axial but whose path through the pole pieces depends on the angular orientation of the rotor.

Figure 4:
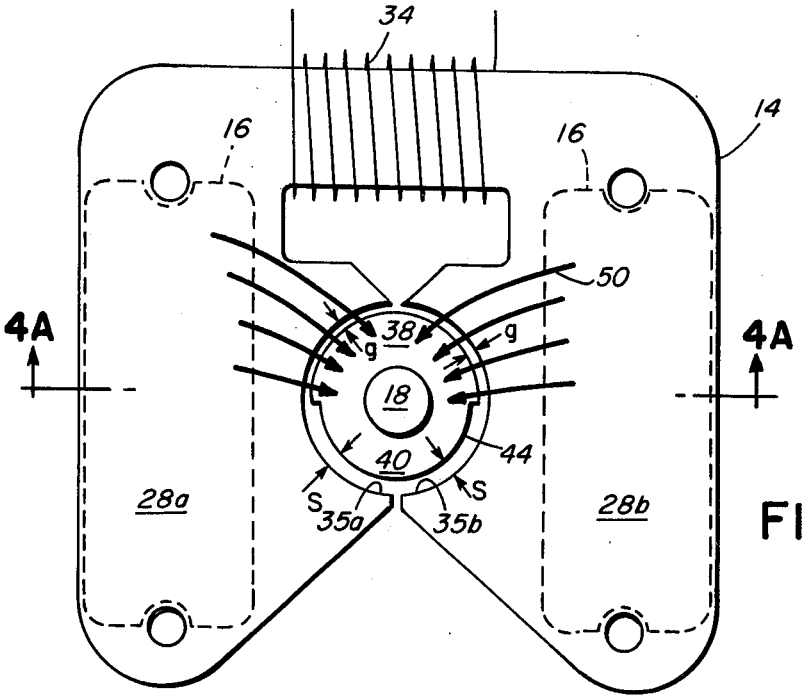
FIG. 4 is a top view of the actuator of FIG. 1 (with the end caps removed and the coil shown diagrammatically), showing representative bias flux paths for the rotor in its central position.
Figure 4A:
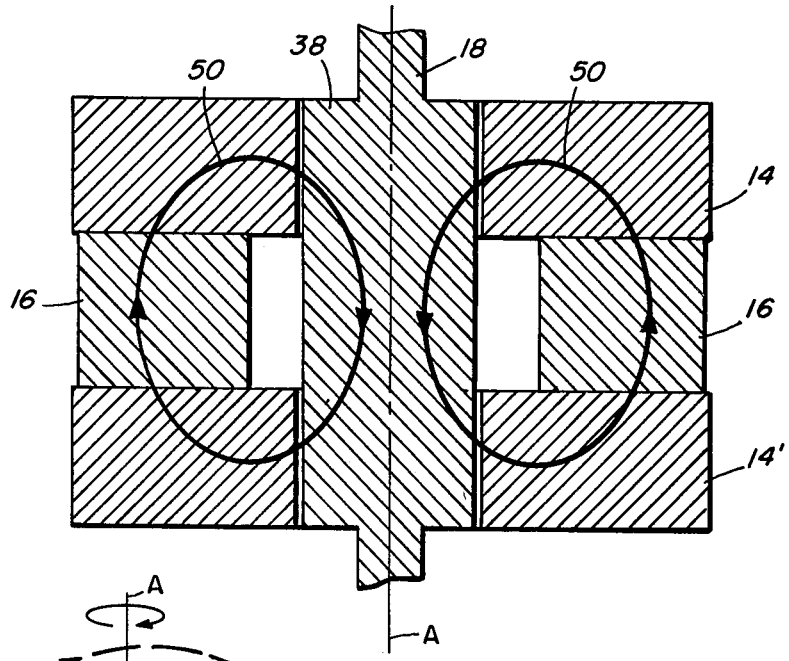
FIG. 4A is a sectional side view (at section 4—4 in FIG. 4) of the actuator of FIG. 4, showing representative bias flux paths.
Figure 4B:
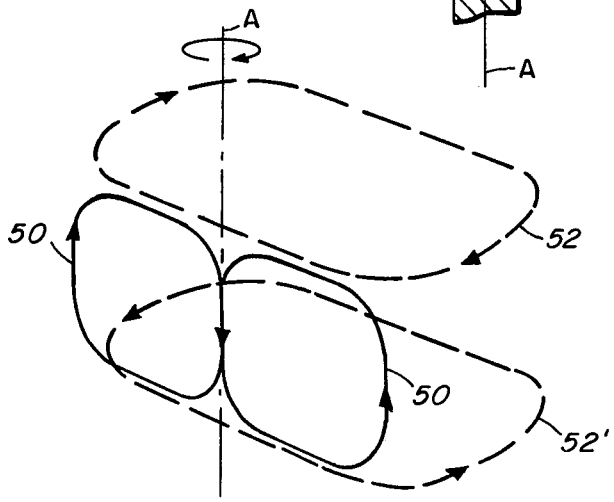
FIG. 4B is an isometric view of representative bias flux paths and control flux paths corresponding to the actuator of FIG. 4.

Referring to FIGS. 4, 4A, and 4B, when the rotor is oriented in its central position as shown (i.e., with each rotor pole face 42, 42' spanning equal portions of its corresponding two stator pole faces), the biasing flux paths 50 flow from the north pole of magnets 16 inwardly across legs 28*a*, 28*b* of pole piece 14 toward the rotor, across gaps g between the stator pole faces and the rotor pole face 42 into the upper end of the rotor, axially in the rotor into the lower end of the rotor, outwardly across gaps g between the pole faces 42' of the lower rotor segment and the stator pole faces 35*a'*, 35*b'* of the lower pole piece, outwardly across legs 28*a'*, 28*b'*, and inwardly into the south poles of the magnets.

When the rotor is positioned at an angle to the central position, each pole face 42, 42' has a greater area of exposure to one of the corresponding stator pole faces than to the other, so that for each pole face 42, 42' more of the biasing flux can cross the gap g at one of its corresponding stator pole faces than the other. The connecting segment 31, 31' of each stator pole piece provides a path for the excess biasing flux.

Figure 5:
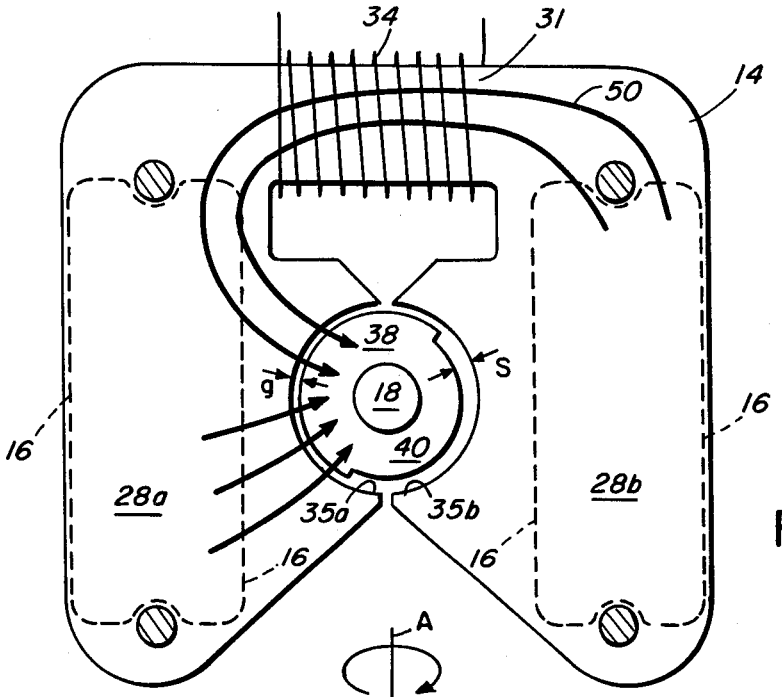
FIG. 5 is a top view of the actuator of FIG. 1 (with the end caps removed and the coil shown diagrammatically), showing representative bias flux paths for the rotor near its furthest angular excursion in the counterclockwise direction.
Figure 5A:
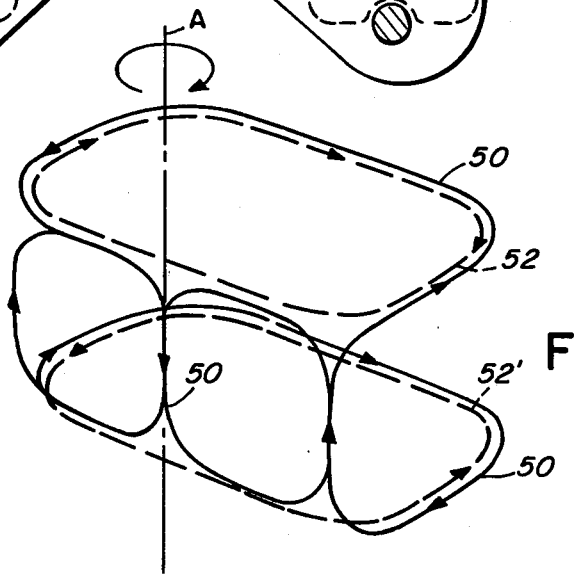
FIG. 5A is an isometric view of representative bias flux paths and control flux paths corresponding to the actuator of FIG. 5.

Thus, referring to FIGS. 5 and 5A, with the rotor positioned near its greatest angle of rotation away from the central position, most of the biasing flux paths 50 must pass through the connecting segments of the pole pieces, although a small part of the flux continues to follow a path similar to the path followed in the case of the central position.

Regardless of the position of the rotor, the biasing flux path 50 always passes axially through the rotor, and (when the rotor is not in the central position) some flux passes through the connecting segments. In the absence of a control current in the control coils 34, 34', no torque is imposed on the rotor, regardless of the rotor position. Torque can be defined as the change in the total magnetic energy in the four gaps (defined between the two pole faces 42, 42' and their corresponding stator pole faces 35*a*, 35*b*, 35*a'*, 35*b'*) as the rotor tends to turn. Because the total volume in the four gaps and the total magnetic field in the gaps would remain unchanged with movement of the rotor, no torque would be induced, hence the rotor has no preferential position.

To impose a torque on the rotor (and thereby move it in a desired direction), a current is applied to the control coils, which establishes a pair of control flux paths 52, 52' (shown in FIGS. 4B, 5A). Each control flux path flows only in one of the stator pole pieces and imposes a torque on the corresponding rotor segment. Because of the directions of flow of the two control flux paths, the torques on the two segments reinforce each other. Thus, with the current flowing in a particular direction in control coil 34, control flux path 52 circulates in pole piece 14 through connecting segment 31 and leg 28*b*, across the gap between stator pole face 35*b* and rotor pole face 42, across section 38 of rotor 30, across the gap between stator pole face 35*a* and rotor pole face 42, and through leg 28*a* back to connecting segment 31. (Flux line 52' takes a similar path (but in the opposite direction) through pole piece 14' and rotor segment 38'). Flux path 52 reinforces the bias flux path 50 passing across the gap between pole faces 35*b*, 42 and opposes the bias flux path 50 passing across the gap between pole faces 35*a*, 42. As a result, a torque will be imposed on rotor 30 at pole face 42 tending to turn the rotor in the direction which will cause an increase in aggregate flux across the two gaps (in this case clockwise).

At the same time, flux path 52' takes a similar path through pole piece 14' and rotor segment 38, except in the opposite direction, which is accomplished by arranging the current to flow in the appropriate direction through control coil 34'. The torque imposed by coil 34' is also clockwise, reinforcing the torque imposed by coil 34.

A counterclockwise torque can be imposed in an analogous manner by reversing the direction of the current through the coils. The size of the torque created by the current in the coils is determined (to a first approximation) by the equation $$T = BLNiD \text{ (Newton-meter)}$$

where

B=magnetic flux in gaps between rotor and stator induced by biasing magnets

L=thickness of each pole piece

N=number of turns on each control coil i=current in each control coil

D=diameter of pole piece rotor bore

Should current be continually applied, the rotor will turn until it reaches a position where the conditions for torque generation are broken, either because the rotor pole faces no longer straddle both stator pole faces or because the iron of the structure becomes saturated.

Figure 6:
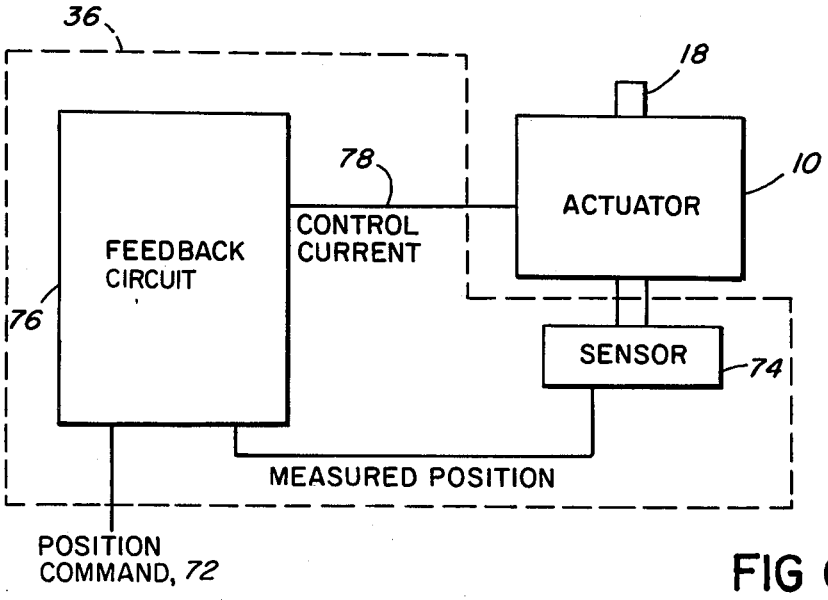
FIG. 6 is a block diagram of a feedback-driven, controlled-current source for the actuator.

Referring to FIG. 6, controlled current source 36 typically comprises a source of position command signals 72, a rotor position sensor 74, and a suitable feedback circuit 76. The feedback circuit, in a known manner, regulates the control current 78 in accordance with errors between actual and desired positions, thus to enable the rotor to accurately follow the command signals in a suitably damped manner. (Details of one possible control circuit are set forth in U.S. Pat. No. 4,142,144, Rohr, Feb. 27, 1979, assigned to the same assignee as this application and hereby incorporated by reference.)

OTHER EMBODIMENTS

Other embodiments are within the following claims.

Figure 7:
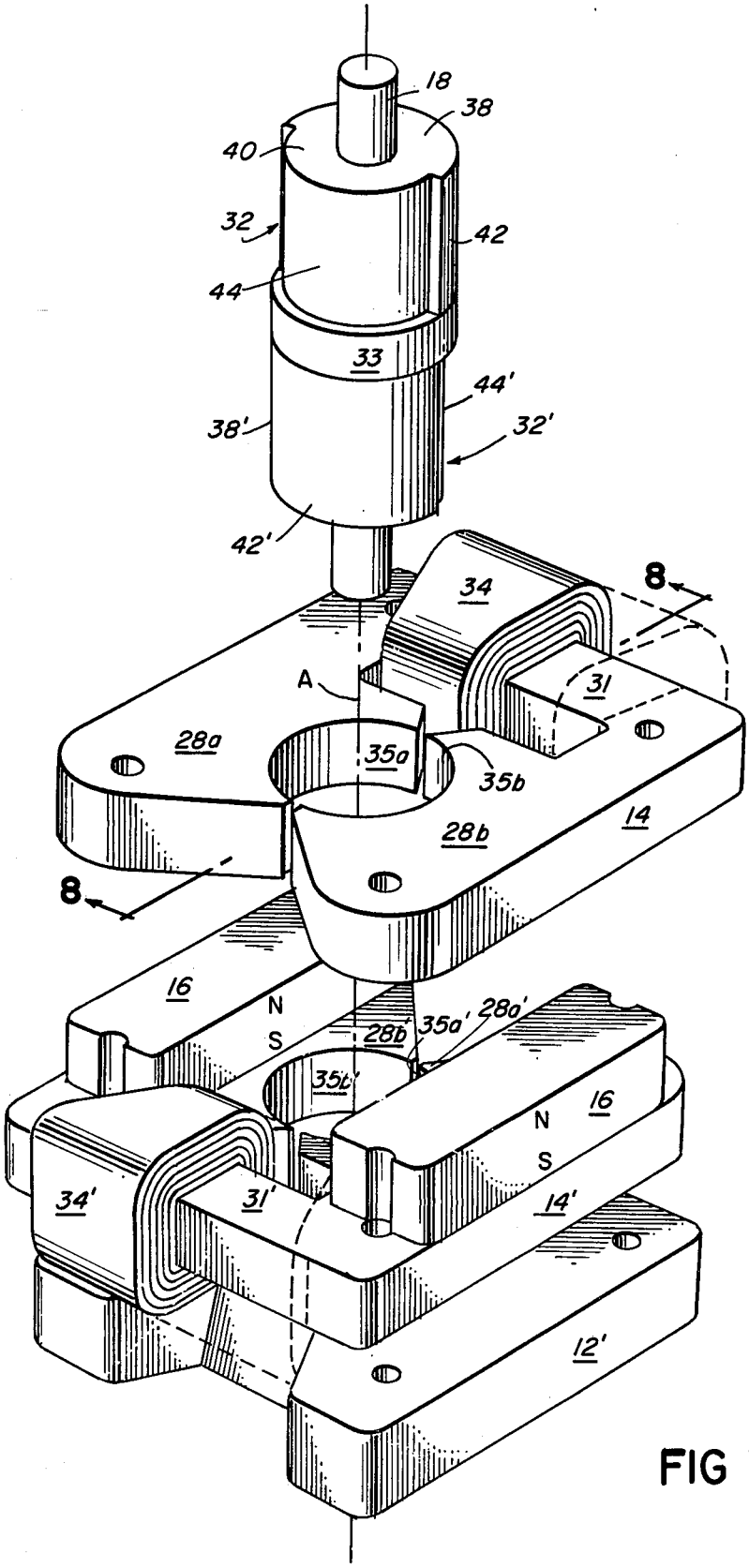
FIG. 7 is an exploded isometric view of another embodiment of the actuator, with one end cap removed, the rotor assembly shown axially separated from the stator assembly, and the coils shown cut away.
Figure 8:
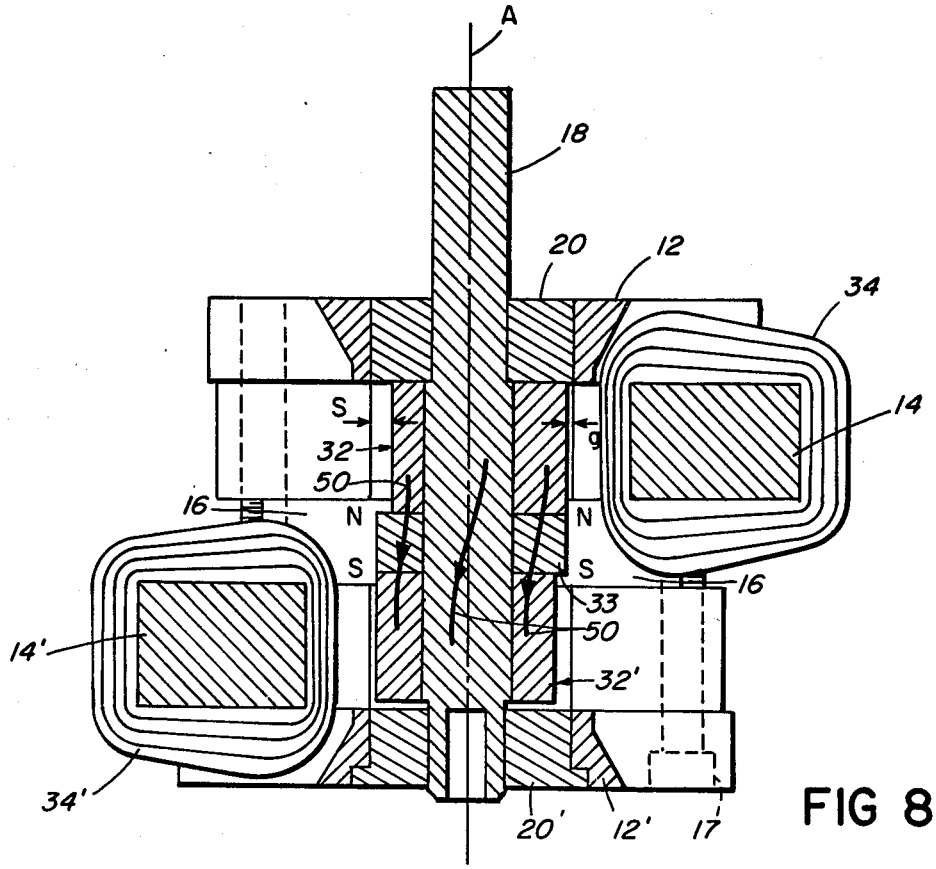
FIG. 8 is a sectional side view (at section 8—8 of FIG. 7) of the actuator of FIG. 7.

For example, referring to FIGS. 7, 8, two rotor segments 32, 32' can be mounted on shaft 18 so that rotor pole faces 42, 42' are on opposite sides of axis A, and pole pieces 14, 14' then can be assembled with their connecting segments 31, 31' and coils 34, 34' on opposite sides of axis A. This arrangement permits pole pieces 14, 14' to be mounted closer together because coils 34, 34' do not encroach on each other's space. Ring-shaped segment 33, having a thickness of at least ½ the difference in diameters between pole faces 42 and 44, assures better bias flux flow between segments 38, 38', as illustrated by flux paths 50 in FIG. 8. (Ring-shaped segment 33 could alternatively be eliminated).

In other embodiments the angular displacement around the axis between the respective connecting segments and the respective rotor pole faces could be any value between 0° and 180°.

I claim:

1. In a limited rotation actuator comprising a permeable rotor assembly positioned to rotate relative to a stator assembly, said stator assembly having a pair of pole pieces, each pole piece defining a pair of permeably connected stator pole faces arranged around the axis of said rotor assembly, said rotor assembly defining a pair of permeably connected rotor pole faces, each rotor pole face being arranged to cooperate with associated stator pole faces, and a permanent magnet means for imposing a bias flux through said pole pieces and said rotor assembly via associated sets of rotor and stator pole faces, said pole pieces being permeably connected to respectively opposite pole faces of said permanent magnet means, the improvement wherein said rotor pole faces are spaced apart along said axis and permeably connected by a flux path having an axial component through said rotor assembly, and, each said rotor and stator pole face subtends an angle of between about 90° and about 180° around said axis,

2. The improvement of claim 1 wherein each said rotor pole face subtends an angle of approximately 180°.

3. The improvement of claim 1 wherein each said stator pole face subtends an angle between about 120° and about 160°.

4. The improvement of claim 1 wherein said pole pieces are located in substantially parallel planes, said planes being perpendicular to and spaced apart along said axis, and each said pair of stator pole faces is permeably connected by a connecting portion of its respective pole piece.

5. The improvement of claim 2 wherein said permanent magnet means comprises a permanent magnet positioned in the axial space between said pole pieces.

6. The improvement of claim 1 wherein said connecting portions of said pole pieces are respectively oriented 180° apart with respect to said axis.

7. The improvement of claim 1 wherein said connecting portions of said pole pieces are respectively aligned on the same side of said axis.

8. The improvement of claim 1 wherein at least one of said connecting portions is associated with a flux generating means for causing a flux through said pole piece and said rotor assembly for imposing a torque on said rotor assembly.

9. The improvement of claim 5 wherein said flux generating means comprises a current carrying coil wrapped around said connecting portion.

10. The improvement of claim 1 wherein said rotor assembly comprises a pair of permeably connected segments at different positions along said axis, each said segment comprising a pair of arcuate sections of different radii centered on said axis, the arcuate section which has the larger radius defining one said rotor pole face, and the other said arcuate section defining a relief surface, the spaces between said relief surfaces and said stator pole faces being sufficiently large to be substantially impermeable.

11. The improvement of claim 1 or 7 wherein said rotor pole faces are located respectively on opposite sides of said axis.

12. The improvement of claim 11 further comprising a cylindrical segment having a radius greater than the smaller said radius, said cylindrical segment being centered on said axis, positioned axially intermediate said segments, and permeably connected to said segments.

13. The improvement of claim 1 or 7 wherein said rotor pole faces are located respectively on the same side of said axis.

* * * * *